US008356698B2

(12) United States Patent
Zepke et al.

(10) Patent No.: US 8,356,698 B2
(45) Date of Patent: Jan. 22, 2013

(54) WIRELESS ELEVATOR HALL FIXTURES INTEGRAL WITH HALL DOOR FRAME

(75) Inventors: Bruce Zepke, Glastonbury, CT (US); Adriana Bacellar, Glastonbury, CT (US); Luiz Bacellar, Glastonbury, CT (US); Dennis Bellamy, Stafford Springs, CT (US); Christian Netter, West Hartford, CT (US); Alberto Vecchiotti, Atlanta, GA (US); William Veronesi, Hartford, CT (US); David Crenella, Berlin, CT (US); Michael Gozzo, Noank, CT (US); Deborah C. Haas, Coventry, CT (US); Joseph Zacchio, Wethersfield, CT (US); Paul Stucky, Vernon, CT (US)

(73) Assignee: Otis Elevator Company, Farmington, CT (US)

( * ) Notice: Subject to any disclaimer, the term of this patent is extended or adjusted under 35 U.S.C. 154(b) by 1585 days.

(21) Appl. No.: 10/549,605

(22) PCT Filed: Mar. 20, 2003

(86) PCT No.: PCT/US03/08532

§ 371 (c)(1),
(2), (4) Date: Aug. 10, 2010

(87) PCT Pub. No.: WO2004/094288

PCT Pub. Date: Nov. 4, 2004

(65) Prior Publication Data

US 2010/0294599 A1 Nov. 25, 2010

(51) Int. Cl.
*B66B 1/06* (2006.01)

(52) U.S. Cl. ..... 187/290; 187/391

(58) Field of Classification Search ..... 187/290, 187/380, 391–394, 396, 413, 414; 320/2, 320/12, 21

See application file for complete search history.

(56) References Cited

U.S. PATENT DOCUMENTS 4,402,386 A 9/1983 Ficheux et al.

(Continued)

FOREIGN PATENT DOCUMENTS

CN 13226896 A 12/2001
CN 1340453 A 3/2002

(Continued)

OTHER PUBLICATIONS

PCT International Search Report for PCT/US03/08532, dated Sep. 4, 2003.

International Preliminary Examination Report for PCT/US03/08532, dated Aug. 25, 2004.

(Continued)

*Primary Examiner* — Anthony Salata
(74) *Attorney, Agent, or Firm* — Kinney & Lange, P.A.

(57) ABSTRACT

Fixtures (22, 27) at a doorway (13) of a landing (14) are formed integrally with a door frame (17, 17*a*). The fixtures include electronic modules (42, 46, 54) and energy storage devices (43, 47, 55). Power may be supplied by a generator (32) rotated by a pinion (34) in response to a rack (35) on a hoistway door (20), or by electrical contacts (58) disposed on the hoistway side of the door frame which touch contacts (65) on an elevator car door (63) when the door is open, thereby receiving power over a line (66) from the elevator car; or power may be provided by an inductive coupler (70). The fixtures (22, 27) may be within the profile of the door frame (17), or extend outwardly from the profile of the door frame (17*a*).

11 Claims, 5 Drawing Sheets

U.S. PATENT DOCUMENTS

| | | | | |
|---|---|---|---|---|
| 4,657,117 | A * | 4/1987 | Lauer | 187/289 |
| 5,341,902 | A * | 8/1994 | Ruiz et al. | 187/251 |
| 5,732,795 | A * | 3/1998 | McCarthy et al. | 187/250 |
| 6,357,555 | B1 | 3/2002 | Koza et al. | |
| 6,408,986 | B1 * | 6/2002 | Ayano et al. | 187/290 |
| 6,481,531 | B1 * | 11/2002 | Nagura et al. | 187/247 |
| 6,601,679 | B2 * | 8/2003 | Crenella et al. | 187/395 |
| 6,626,267 | B2 * | 9/2003 | Beus et al. | 187/290 |
| 7,134,530 | B2 * | 11/2006 | Motoyama et al. | 187/391 |
| 7,479,861 | B2 * | 1/2009 | Zepke et al. | 336/178 |
| 7,896,137 | B2 * | 3/2011 | Ishikawa | 187/290 |
| 7,958,971 | B2 * | 6/2011 | Mangini et al. | 187/396 |
| 8,083,033 | B2 * | 12/2011 | Kallioniemi et al. | 187/290 |
| 2002/0023802 | A1 | 2/2002 | Ayano et al. | |
| 2002/0112924 | A1 | 8/2002 | Mori et al. | |

FOREIGN PATENT DOCUMENTS

| | | | |
|---|---|---|---|
| EP | 1 396 454 | A1 | 3/2004 |
| JP | 5294568 | | 9/1993 |
| JP | 7-40666 | | 7/1995 |
| JP | 1-68377 | | 2/1999 |
| JP | 2003-246564 | | 2/2003 |
| WO | WO 02/098779 | A1 | 12/2002 |

OTHER PUBLICATIONS

Japanese Patent Office, Office Action Concerning Japanese Counterpart Application No. 2004-571141, Nov. 2008.

Patent Office of the People's Republic of China First Office Action Concerning Chinese Counterpart Application No. 03826192.8, Mar. 2003.

* cited by examiner

WIRELESS ELEVATOR HALL FIXTURES INTEGRAL WITH HALL DOOR FRAME

This Application is a 371 of PCT/US2003/008352 filed Mar. 20, 2003.

TECHNICAL FIELD

This invention relates to the elimination of building wiring for the purpose of powering elevator hall fixtures including call button lights, directional lanterns, and floor indicators, by having the hall fixtures mounted integrally within the hallway door frame, with all of the necessary apparatus prewired, including controls, wireless communication apparatus, and power storage devices; power is supplied to the hall fixtures by either contacts which draw power from the elevator while it is at the landing, or inductive coupling, of power from the elevator while it is at the landing, or power generated by movement of the hoistway door when the elevator is at the landing.

BACKGROUND ART

Elevator systems have hallway fixtures at each floor, including directional lanterns, hall call buttons, and in some cases, elevator position indicators. Traditionally, each hallway fixture on every floor was powered by means of wires run through the hoistway, with additional wires to provide signal communication between the floor and the controller, which has typically been located at the top of the hoistway in a machine room. To reduce the amount of wiring, modern systems use serial communication buses which typically may require two wires for communication and two for power, one bus each for the lanterns and call buttons. The wiring requires significant installation time in new buildings, and makes modernization of existing elevators extremely difficult. Further, work in the hoistway is dangerous and should be avoided if possible.

The communication aspect of hall fixtures has been rendered wireless by means of radio frequency (or other) wireless communications. However, power is still required to be provided by wires, which must be specifically installed in the building during initial construction of an elevator system, or as a consequence of modernization.

DISCLOSURE OF INVENTION

Objects of the invention include: provision of completely wireless elevator hallway fixtures; provision of elevator hallway fixtures which receive power without requiring building wiring, and particularly wiring in a hoistway; and hallway fixtures which require essentially no installation in a building.

This invention is predicated, on providing hallway fixtures which are completely wired at the factory within a hallway door frame, including low power communications modules, effective energy storage, and a source of energy which does not require direct connection to building wiring.

According to the present invention, an elevator door frame includes the directional lanterns and hall call buttons, together with control, wireless communications and energy storage, along with a mechanism for receiving energy from an elevator car, all completely wired together so that installation of the hall door frame completes the installation of the hallway fixtures. The doorway may also include an elevator position indicator.

According further to the invention, power for the hall fixtures may be provided by a generator operated in response to motion of the hoistway door; or power may be provided by magnetic coupling with a source on an elevator car; or power may be provided by electrical contacts which become operative when an elevator is at the related landing.

The invention obviates the need for any wiring whatsoever at the installation site and permits complete installation of the hallway fixtures by merely installing the hall door frame.

Other objects, features and advantages of the present invention will become more apparent in the light of the following detailed description of exemplary embodiments thereof, as illustrated in the accompanying drawing.

MODE(S) FOR CARRYING OUT THE INVENTION

Figure 1:
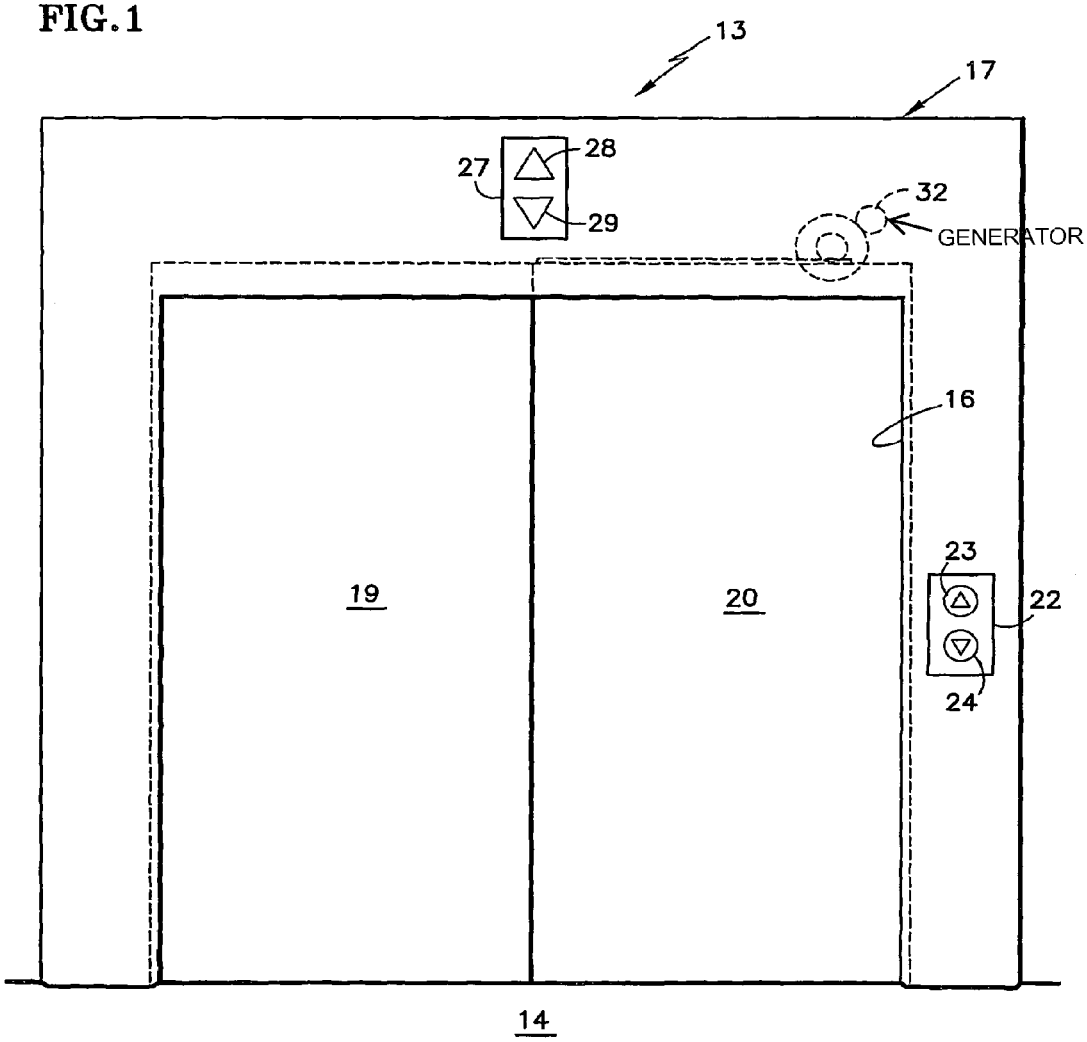
FIG. 1 is a front elevation view of a hall door frame having fixtures and employing a door operated generator as a source of power, in accordance with the invention.

Referring to FIG. 1, the doorway 13 at a landing 14 of an elevator includes a hoistway door opening 16 defined by a door frame 17. The opening 16 is closed off by hoistway doors 19, 20 except when a car is servicing the landing 14 (which means stopped and opening the doors). The door frame includes a call module 22 which has one or two hall call buttons, in the conventional fashion such as an up call button 23 and a down call button 24. The call buttons may be illuminated by LEDs, or in some other suitable way, to indicate that a call has been registered. The door frame 17 also includes a lantern fixture 27 having one or two conventional directional arrows, such as an up directional arrow 28 and a down directional arrow 29 that are selectively illuminated to indicate the direction of elevator travel. The arrows may be illuminated by high-intensity LEDs, or in some other suitable way, to indicate car direction. In the embodiment of FIG. 1, the fixtures 22, 27 are powered by a generator 32, which is seen more clearly in FIG. 2. The generator 32 is driven by a gear 33 which is coupled to a pinion 34 that is rotated by a rack 35 when the hoistway door 20 is opened upon the occurrence of an elevator servicing passengers at the landing. Assuming a one meter door motion in two seconds, proper gear ratios can result in a motor speed of around 1800 rpm. A permanent magnet low voltage DC generator can readily provide on the order of 0.014 watt hours (50 joules) of energy which would be sufficient to power typical fixture operation, if low-power radio technology is utilized, for about four hours. This may put an additional force on the door operating mechanism of on the order of 11 pounds (about 5 kilograms). Other generator configurations may, of course, be utilized if desired.

Figure 2:
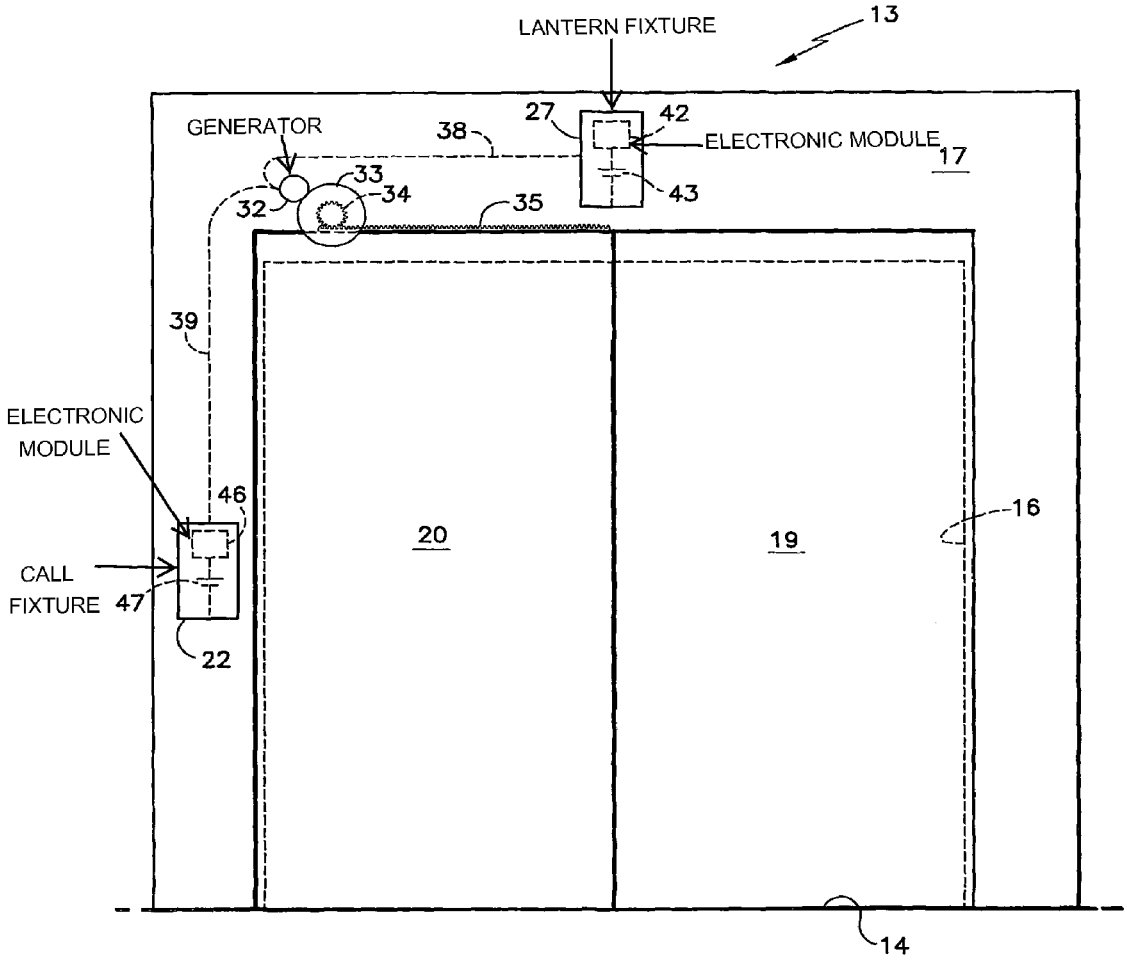
FIG. 2 is a rear elevation view of the hallway door frame of FIG. 1.

In FIG. 2, the generator 32 is shown connected independently by wires 38, 39 to the lantern fixture 27 and to the call fixture 22. The lantern fixture 27 may have its own electronic module 42 and its own energy storage device, which may be a battery 43 or a super capacitor, all as is known in the art. Similarly, the call fixture 22 may have its own electronic module 46 and energy storage device, such as battery 47. The electronic module 42 may include power monitoring and communication, such as by radio frequency electromagnetic radiation, as well as controlling the application of power to the directional lights 28, 29. The module 46 may include communication capability, monitoring of the power of the battery 47, and control over application of illumination to the up and down hall call buttons 23, 24. The modules 42, 46 may take the form, disclosed in commonly owned, copending patent application PCT/US02/32848, of piconet modules, which may comprise modules conforming to BLUETOOTH specifications, utilized in the manner described in that application. Other electronic modules which can operate with extreme low power consumption and provide adequate control and communication may be utilized, as desired.

Figure 3:
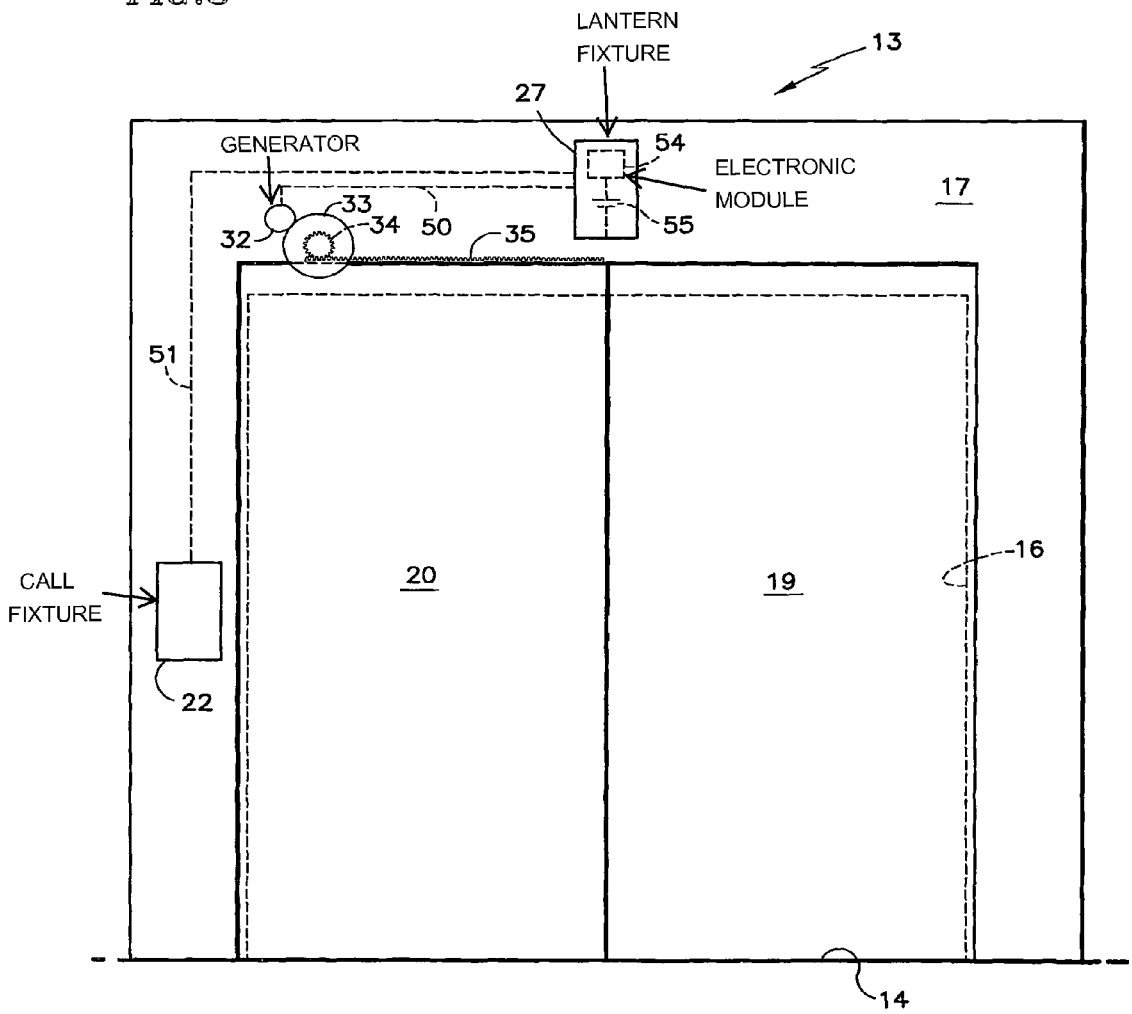
FIG. 3 is a rear elevation view of a slight modification of the hallway door frame of FIG. 1.

FIG. 3 illustrates that the generator 32 may be connected by a wire 50 only to one of the fixtures, such as the lantern fixture 27, the other fixture, such as the hall call fixture 22, being powered by a wire 51 from the lantern fixture. Also, FIG. 3 illustrates that a single electronic module 54 and a single energy storage device 55 may be used to power and control both of the fixtures 22, 27. Or, the electronic module and energy storage could be provided in the call button fixture 22 to power and control both fixtures 22, 27.

Figure 6:
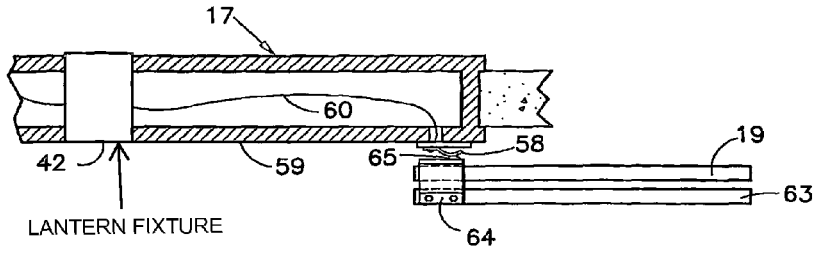
FIG. 6 is a partial, partially sectioned, top view of the door frame of FIG. 4.
Figure 4:
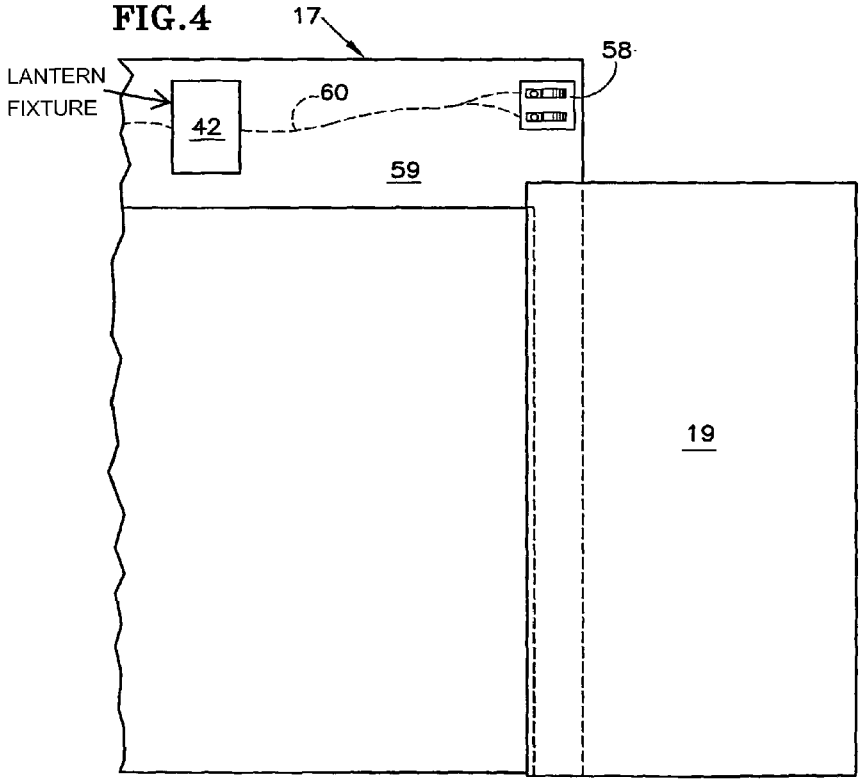
FIG. 4 is a partial rear elevation view of a hallway door frame of the invention employing contacts.
Figure 5:
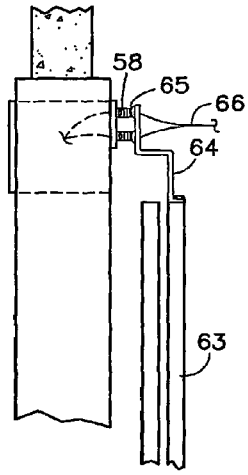
FIG. 5 is an end elevation view of the door frame of FIG. 4.

In FIG. 4-6, a pair of electric contacts 58 are disposed directly on the inside wall 59 of the door frame 17. The contacts are prewired with a wire 60 to the lantern fixture 42. The elevator car door 63 has a bracket 64 that mounts complementary electrical contacts 65 powered from the elevator car by a wire 66. Each time that the elevator car door is opened, the contacts 58, 65 are electrically connected, thereby providing power from the wire 66 to the wire 60, resulting in energy being stored in the energy storage device 43, 47, 55 (FIGS. 2 and 3).

Figure 7:
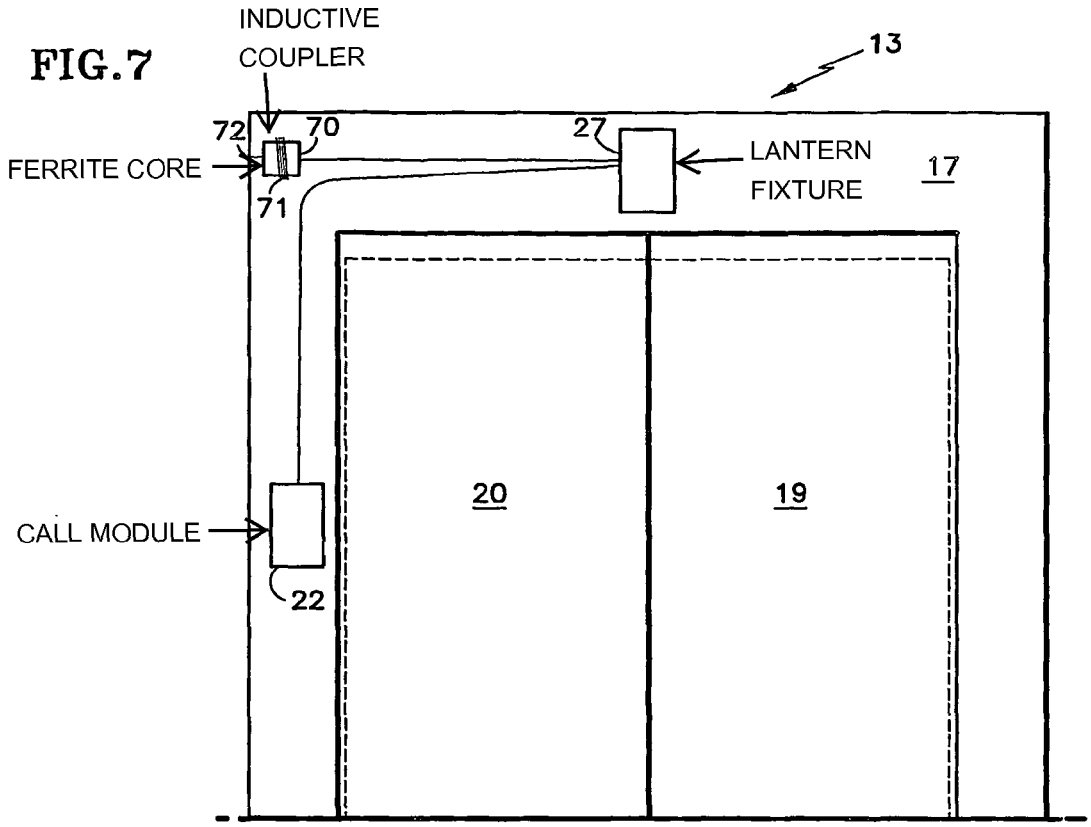
FIG. 7 is a rear elevation view of a door frame of the invention acquiring power by means of an inductive coupler.

Instead of using a generator or a pair of contacts to receive power from the elevator car when it is servicing a landing, inductive power coupling may be utilized as illustrated in FIG. 7. There are a number of inductive coupling mechanisms available in the prior art, any one of which can be chosen for use as desired. However, it may be preferable to use the efficient inductive coupler 70, having few turns of wire 71 but a very large ferrite core 72, as is disclosed in a commonly owned copending patent application WO/2005/005,299, filed contemporaneously herewith. On the elevator car, an inductive coupler similar to the coupler 70 receives high frequency power from a bridge, which high frequency power is rectified and applied to the storage device within the lantern fixture 27, all in a manner as is known in the art.

Figure 8:
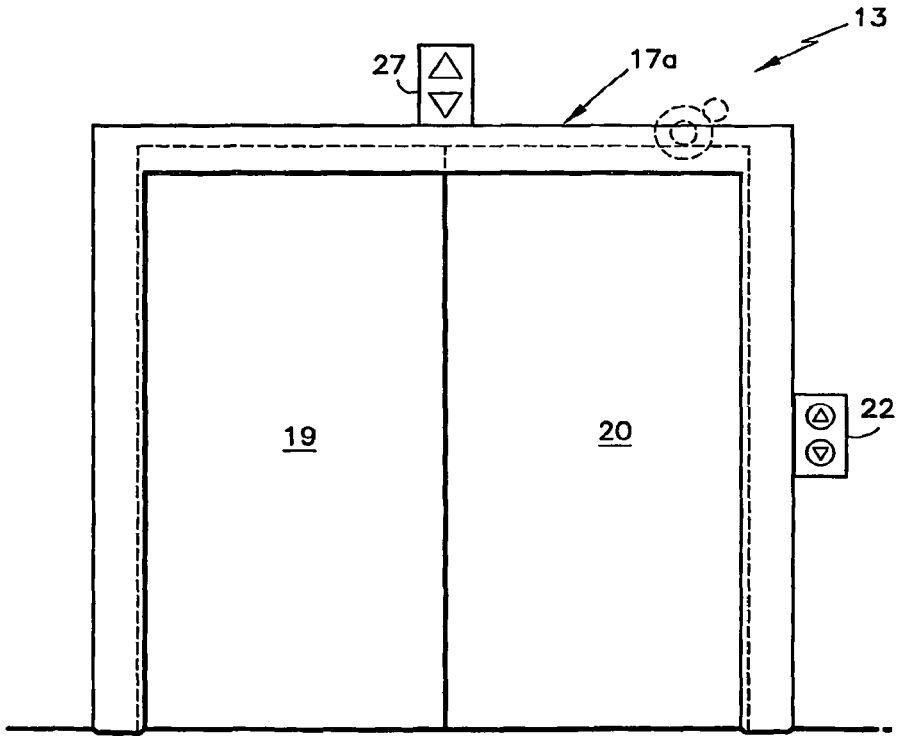
FIG. 8 is a front elevation view of an alternative form of hall door frame according to the invention.

FIG. 8 illustrates that the hall call fixture 22 and the lantern fixture 27 need not necessarily be disposed within the silhouette of a door frame 17*a* but could instead extend outwardly therefrom, thereby enabling use of smaller and lighter frame 17*a*. The fixtures 22, 27 may, however, be integrally formed with the frame 17*a* and have all of the electronics, energy storage and wiring, as well as the power transfer apparatus which has been described hereinbefore. Or, the fixtures could be shipped as separate units, with a physically anchoring and electrical-connecting plug-in connection to the frame.

If sufficient power is provided, either or both of the fixtures could use display devices of various sorts to provide the desired indications.

We claim:

1. An integral doorway (13) for a landing (14) of an elevator having a controller, and a car with at least one door, comprising:

a door frame (17);

at least one hoistway door;

a lantern fixture (27) integral with said door frame;

a hall call button fixture (22) integral with said door frame;

at least one of said fixtures having an electronic module (43, 46, 54) for control over said fixtures and for providing communication between said fixtures and said controller;

at least one of said fixtures having an energy storage device (43, 47, 55) for providing operational power to said one or more electronic modules and lighting power to said fixtures;

power means operative in response to said elevator servicing said landing to transfer energy from said elevator to said at least one energy storage device; and wiring disposed within said door frame for interconnecting said power means with said fixtures, said at least one electronic module, and said at least one storage device (between), wherein the power means comprises a generator moved in response to motion of a door.

2. A doorway according to claim 1 having one said storage device located within one of said fixtures.

3. A doorway according to claim 1 having one said electronic module located within one of said fixtures.

4. A doorway according to claim 1 wherein said power means comprises a generator moved in response to a pinion interconnected with a rack disposed on one of said hoistway doors.

5. A doorway according to claim 1 wherein said power means comprises contacts disposed on the hoistway side of said door frame and contacts disposed on said elevator car, said contacts providing power from said elevator car to said door frame through said contacts.

6. A doorway according to claim 5 wherein said power means comprises electrical contacts on an elevator car door which make a connection with electrical contacts at said landing.

7. A doorway according to claim 5 wherein said power means comprises electrical contacts on an elevator car door which make contact when said door is open.

8. A doorway according to claim 1 wherein said power means comprises inductive coupling means for coupling power from the elevator car to the door frame when the elevator car is stopped at said landing.

9. A doorway according to claim 1 wherein said fixtures are disposed within said door frame.

10. A doorway according to claim 1 wherein said fixtures are joined to and extend outwardly from said door frame.

11. A doorway according to claim 1 wherein said fixtures are integral with said door frame.

* * * * *